US007432787B2

(12) United States Patent
Muench et al.

(10) Patent No.: US 7,432,787 B2
(45) Date of Patent: Oct. 7, 2008

(54) MOTORIZED LOADBREAK SWITCH CONTROL SYSTEM AND METHOD

(75) Inventors: Frank John Muench, Waukesha, WI (US); Patrick Harold Pride, Mukwonago, WI (US); John Fredrick Banting, Waukesha, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/304,479

(22) Filed: Dec. 15, 2005

(65) Prior Publication Data

US 2007/0138143 A1 Jun. 21, 2007

(51) Int. Cl.
*H01H 3/00* (2006.01)

(52) U.S. Cl. ..... 335/76; 200/400; 218/1

(58) Field of Classification Search ..... 335/68–76, 335/167–176; 218/1, 7, 14, 152–154; 200/400, 200/401

See application file for complete search history.

(56) References Cited

U.S. PATENT DOCUMENTS

| | | | | |
|---|---|---|---|---|
| 2,591,017 | A | 4/1952 | Schultz | |
| 3,246,100 | A | 4/1966 | Russell | |
| 3,316,367 | A * | 4/1967 | Kowalski | 200/48 R |
| 3,590,183 | A * | 6/1971 | Leonard | 200/441 |
| 3,789,172 | A * | 1/1974 | Cole et al. | 335/76 |
| 3,944,772 | A * | 3/1976 | Davies | 335/76 |
| 4,245,140 | A * | 1/1981 | Jencks et al. | 335/68 |
| 4,412,116 | A * | 10/1983 | Golub | 200/571 |
| 5,552,647 | A | 9/1996 | Tinkham | |
| 5,925,405 | A * | 7/1999 | Ali-Khan | 427/180 |
| 6,559,743 | B2 * | 5/2003 | Narayanan et al. | 335/68 |
| 6,797,909 | B2 | 9/2004 | Pride et al. | |
| 6,825,426 | B2 | 11/2004 | Muench et al. | |
| 7,019,606 | B2 * | 3/2006 | Williams et al. | 335/20 |
| 2003/0187550 | A1 * | 10/2003 | Wilson et al. | 700/295 |
| 2004/0094394 | A1 * | 5/2004 | Muench et al. | 200/14 |
| 2004/0100741 | A1 | 5/2004 | Bosga et al. | |
| 2004/0169014 | A1 * | 9/2004 | Pride et al. | 218/1 |
| 2005/0212629 | A1 * | 9/2005 | Williams et al. | 335/20 |

FOREIGN PATENT DOCUMENTS

| | | |
|---|---|---|
| EP | 0 034 966 | 9/1981 |
| EP | 0 727 858 | 8/1996 |
| GB | 382656 | 10/1932 |
| WO | WO 99/19891 | 4/1999 |
| WO | WO 99/60591 | 11/1999 |
| WO | WO 01/75919 | 10/2001 |

OTHER PUBLICATIONS

OEM Equipment, Four Position Sectionalizing Loadbreak Switches, Cooper Power Systems, Dec. 2003, Marketing Material.
Shanghai Huaming Power Equipment Company, Ltd. Marketing Material, no date.

* cited by examiner

*Primary Examiner*—Elvin Enad
*Assistant Examiner*—Marina Fishman
(74) *Attorney, Agent, or Firm*—King & Spalding

(57) ABSTRACT

A control system and method for a motorized high voltage loadbreak switch.

44 Claims, 6 Drawing Sheets

MOTORIZED LOADBREAK SWITCH CONTROL SYSTEM AND METHOD

BACKGROUND OF THE INVENTION

This invention relates generally to high voltage electrical switches, and more specifically to high voltage loadbreak switches.

Loadbreak switches, sometimes referred to as selector or sectionalizing switches, are used in high-voltage power distributions systems operating at voltages higher than 1,000 volts to connect one or more power sources to a load. Loadbreak switches may be used to switch between alternate power sources to allow, for example, reconfiguration of a power distribution system or use of a temporary power source while a main power source is serviced. To reduce the physical size of the switch or and the installation as a whole, loadbreak switches often are submersed in a bath of dielectric fluid. Successful operation of the loadbreak switch requires a very specific combination of forces, sequences and directions for the switch to operate correctly.

DETAILED DESCRIPTION OF THE INVENTION

Figure 1:
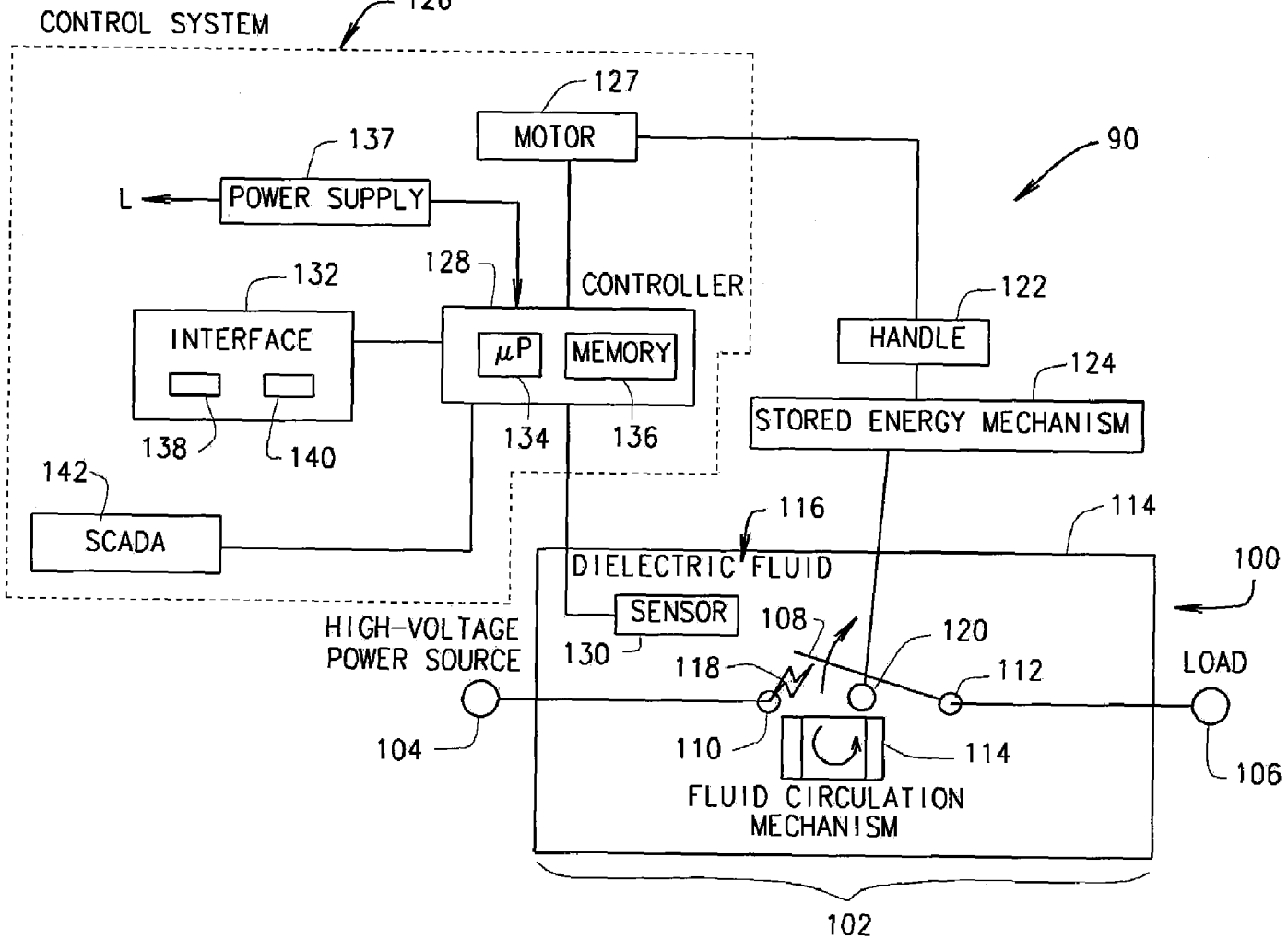
FIG. 1 is a schematic diagram of an exemplary high voltage loadbreak switch system.

FIG. 1 is a schematic diagram of an exemplary high voltage loadbreak switch system 90 that avoids certain problems found in conventional loadbreak switches and provides more reliable operation and remote switching capability for the reasons explained below. The system includes an exemplary loadbreak switch 100, described in some detail below for illustrative purposes only to demonstrate the features of the invention. It is contemplated that the benefits of the invention may accrue to other types of switches, and the invention is not intended to be limited to the particular switch 100 described hereinbelow.

In an exemplary embodiment the loadbreak switch defines an electrical path 102 between a high-voltage power source 104 and a load 106. The electrical path 102 includes a switching mechanism 108 having switch contacts 110 and 112, and the switching mechanism 108 is configured or adapted to open or close the electrical path 102 through the contacts 110 and 112. The high-voltage loadbreak switch 100 may be used within a casing 114 that holds elements of the high-voltage loadbreak switch 100 immersed, for example, in a dielectric fluid 116. In a known manner, the dielectric fluid 116 suppresses arcing 118 when the switching mechanism 108 is opened to disconnect the load 106 from the high-voltage power source 104. In different embodiments, the dielectric fluid 116 may include, for example, base ingredients such as mineral oils or vegetable oils, synthetic fluids such as polyolesters, SF6 gas, and silicone fluids, and mixtures of the same.

The loadbreak switch 100 may be located, for example, in an underground distribution installation, and/or in a polyphase industrial installation internal to a distribution or power transformer or switchgear. Normally, current is carried through the closed metallic contacts 110 and 112. When the switch 100 is opened, the current is carried through an electrical arc that is formed as the contacts 110, 112 open and separate. As those in the art will appreciate, the ability of the high-voltage loadbreak switch 100 to interrupt and extinguish the arc that is formed by the opening of the contacts 110, 112 is a function of the length the arc must travel as the contacts separate, the thermodynamic and dielectric properties of the dielectric fluid 116, the characteristics of the metal contacts 110 and 112, the rate at which the contacts 110 and 112 are separated, the rate that the fluid 116 recovers its dielectric capability as the arc cools and passes through any normal current zero in an AC circuit, and the amount and type of gas, generated as the arc passes through the dielectric fluid.

In view of this, the high-voltage loadbreak switch 100 may optionally include a fluid circulation mechanism 119 that circulates the dielectric fluid 116 around the switching mechanism 108 to improve the strength of the dielectric fluid 116 by removing conductive impurities caused by arcing such as carbonization elements and bubbles.

In an exemplary embodiment, the switching mechanism 108, and the fluid circulation mechanism 108 is carried on a rotating shaft 120 that may be actuated by a handle 122 extending exterior to the casing 114. The handle 122 may be turned, for example, to move the switching mechanism 108 as desired, and markings may be provided on an exterior of the switch casing 114 to indicate the operating position of the switching mechanism when the handle 122 is in a given position. A known stored energy mechanism 124, including, for example, spring elements, may be provided to drive or index the switching mechanism from one position to another to open and close the electrical path 102. In a known manner, turning of the handle 122 charges the stored energy mechanism 124, and once the switching mechanism is released via movement of the handle 122, the stored energy mechanism 124 moves the switching mechanism 108 at a proper speed to extend the arc and interact with the fluid to safely interrupt load current when the switch 100 is operated.

The handle 122 may be operable, for example, to drive the switch mechanism 108 is a clockwise direction or counterclockwise direction to actuate the switch 100.

In one embodiment the switch 100 is, for example, a four position switch, explained further below, wherein the movement of the shaft 120 causes contact blades to shift from one position to another, and the blade movement reconfigures the connection of or isolation of power sources and/or loads by breaking or making electrical connections between contacts rotating with the shaft 120 and stationary contacts fixed to a switch block. When the handle 122 is rotated to charge the stored energy mechanism 124, a cam system releases a locking bar so the shaft 120 is free to rotate. The shaft 120 is then driven by the energy stored in the springs, and the shaft 120 may continue to be rotated in the same direction beyond 360° of rotation by actuating the handle 122. To operate properly, the switch mechanism 108, in response to actuation of the handle 122, must complete a switching operation and revert to an at rest position after completion of the switching operation.

In another embodiment the switch 100 may be a two position on/off switch wherein the stored energy mechanism 124 is an over-toggled-spring that controls motion of the shaft 120 over a range less than 360°. In this case, the movement of the shaft 120 must be reversed to operate the switch between the on and off positions.

In either a two position or four position switch, to operate the switch correctly, the handle 122 typically must be rotated a distance beyond the release point. The movable switch contacts of the switching mechanism 108 are engaged to stationary contacts mounted to switch insulating structures with high enough force between the contacts to ensure acceptable current carrying capability. Consequently, significant input torque is required to move the handle 122 to the point of release, break the connection between the contacts and enable the stored energy mechanism 124 to complete the remainder of the switching mechanism movement. Properly controlling input torque to the handle 122 is difficult, and operators tend to exert excessive force on the handle 122 to release the switching mechanism. Even if actuation of the handle 122 is motorized, a startup torque of the motor is not easy to control, and typically will result in some loading of the stored energy mechanism 124. Additionally, the amount of torque necessary to release the switching mechanism may vary at different times and locations due to temperature fluctuation, current fluctuation, and other factors.

Such loading, to whatever degree, of the stored energy mechanism 124 is undesirable and impairs further use of the switch 100.

Therefore, to ensure proper operation of the switch 100, the loading of the stored energy mechanism 124 due to actuation of the handle 122 must be removed from the stored energy mechanism 124 allowing the mechanism 124 to return to a rest or neutral position before the switch 100 is again operated. When operated manually by a line technician with specially designed tools, the mechanism is self-resetting. If used with a motorized driving system, the self-resetting mechanism can easily be defeated by any residual force left on the mechanism by the motor, thereby frustrating the capability of the switch 100 to be controlled remotely.

To alleviate these and other concerns, in an exemplary embodiment a control system 126 is provided. As shown in FIG. 1, the control system 126 may include a motor 127, a controller 128 communicating with the motor 127, one or more sensors or transducers 130 communicating with the controller 127, and a control interface 132.

The motor 127 is responsive to the controller 128 and is mechanically linked to the switch handle 122 to turn the handle to a position wherein the switch mechanism 108 is released and the stored energy mechanism 124 may complete the movement of the switch mechanism 108 to, for example, a fully opened or fully closed position. As one example, the motor 127 may be a known electric motor, and in a further embodiment the motor 127 may be a stepper motor that rotates an output shaft incrementally to predetermined positions, and the position of the motor output shaft may be precisely positionable. A variety of AC and DC electric motors may be used to power the handle 122 to a release position wherein the stored energy mechanism 124 may complete the movement of the switch mechanism 108.

The controller 128 may be for example, a microcomputer or other processor 134 coupled to the motor 127 and the control interface 132. A memory 136 is also coupled to the controller 128 and stores instructions, calibration constants, and other information as required to satisfactorily operate the switch 100 as explained below. The memory 136 may be, for example, a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to the control system 100 is supplied to the controller 128 by a power supply 137 configured or adapted to be coupled to a power line L. Analog to digital and digital to analog converters may be coupled to the controller 128 as needed to implement controller inputs from the sensor 130 and to implement executable instructions to generate controller outputs to the motor 127

The control interface 132 may be provided, either at the site of the switch 100 or in a remote location, and the interface 132 may include one or more control selectors 138 such as buttons, knobs, keypads, touchpads, and equivalents thereof that may be used by an operator to energize the motor 127 and open or close the switch 100. The interface may also include one or more indicators 140, such as light emitting diodes (LEDs), lamps, a liquid crystal display (LCD), and equivalents thereof that may convey operating and status information to the operator. The control interface 132 is coupled to the controller 128 to display appropriate messages and/or indicators to the operator of the switch 100 and confirm, for example, user inputs and operating conditions of the switch 100.

In response to user manipulation of the control interface 132, the controller 128 monitors operational factors of the switch 100 with one or more sensors or transducers 130, and the controller 128, through the motor 127, actuates the switch handle 122 in a controlled manner explained below. In an exemplary embodiment, the controller 128 may further be coupled to a remote operating control system 142, such as known Supervisory Control and Data Acquisition (SCADA) system. Using the remote operating control system 142, the switch 100 may be remotely monitored and controlled.

Figure 2:
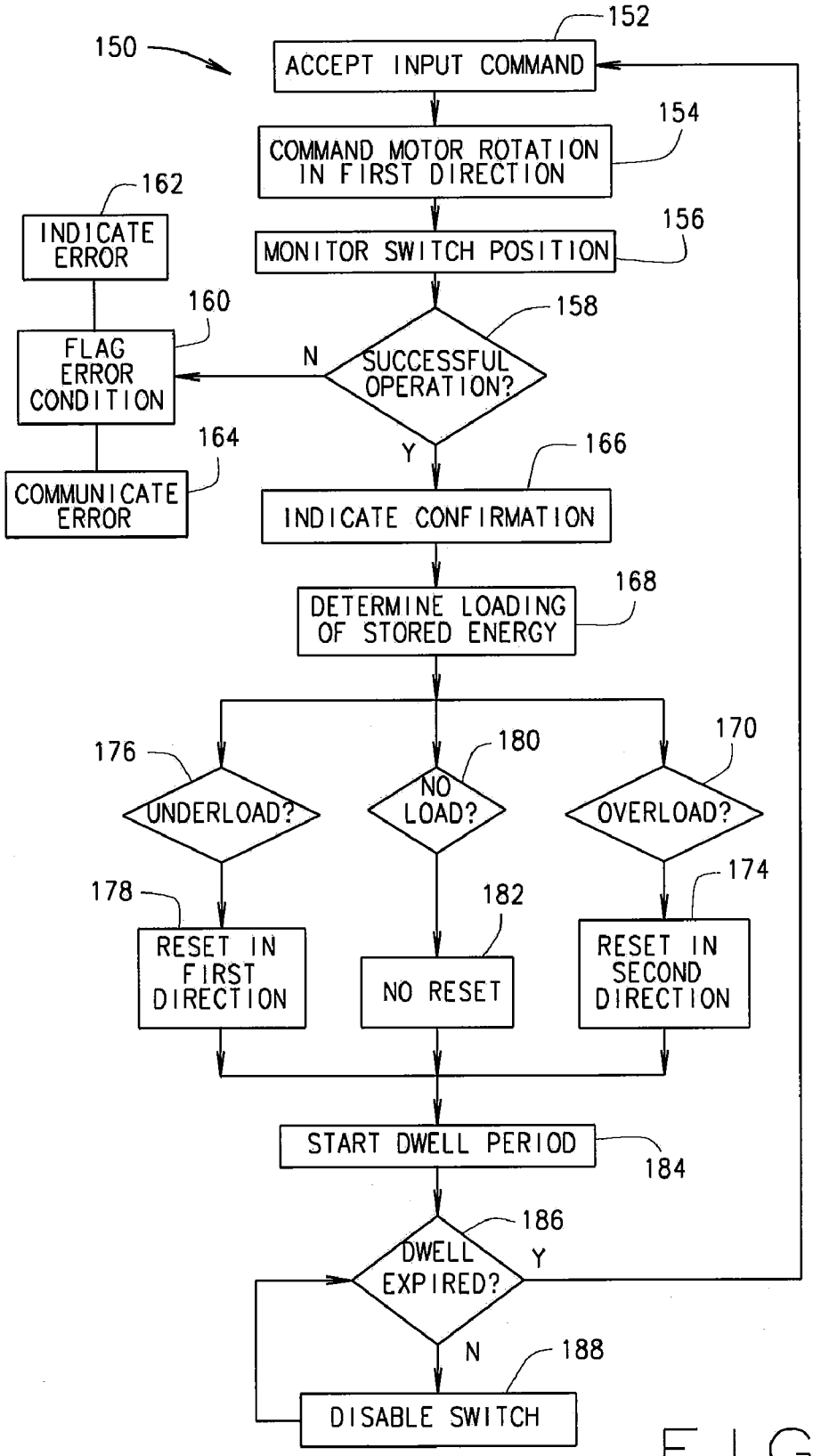
FIG. 2 is a process flowchart executable by the control system shown in FIG. 1.

FIG. 2 is a process flowchart of an exemplary method 150 executable by the control system 126, and more specifically the controller 128.

As shown in FIG. 2, the controller accepts 152 an input command to operate the switch. The input command may be generated by the control interface in response to user manipulation of the control input selector, or alternatively may be received from a remote operation control system. Once the command is accepted 152, the controller commands 154 the motor to generate a rotational output in a first direction to actuate the switch handle to the release position. In response to the command 154, the motor is energized and rotates the handle to move the switching mechanism shaft to a position wherein the switching mechanism is released. Once the release position is achieved, the stored energy mechanism controls indexing of the switching mechanism to a second position as well as the rate of contact separation or closing.

While the motor is operating, the controller monitors 156 an actual operating position of the switching mechanism and/or the switching contacts with the sensor or transducer and determines 158, based upon the actual position of the switching mechanism in the switch casing, whether the switching mechanism movement has been successfully completed. In other words, the controller, in response to feedback signals from the sensor or transducer, determines 158 whether the switching mechanism has been moved completely from a first operating system to a second operating position, and accordingly whether the switch has successfully and safely opened the electrical path, or connected the electrical path to another power source or load, depending upon the configuration of the switch as further explained below.

If the switch mechanism movement is not successful, an error condition is flagged 160 by the controller. Once an error conditions is flagged 160, the error condition may be indicated 162 on the control interface for the switch operator's information. A flagged error condition may also be communicated 164 to the remote operation system. Depending upon the sophistication of the system controller and/or the remote operation system, the type of error condition may be detected and encoded for indication 162 to the operator or communicated 164 to the remote operation system. Error conditions may include, for example, incomplete movement of the switching mechanism and engagement of switch contacts, error conditions in the sensors or sensor communications, controller error conditions, motor error conditions, etc.

If the movement of the switching mechanism is determined 158 to be successful, the controller signals the control interface to indicate 166 a confirmation of proper switch operation to an operator. The controller may also signal the remote operation system to indicate confirmation of a successful switch operation. Visual confirmation may therefore be provided to system operators, local and remote to the switch itself, that proper switch operation has, in fact, occurred. Thus, for example, when the switch is used to open the electrical path, the operator may confirm the opened state of the switch using the indicator prior to servicing the switch or related components connected to the switch. In such a manner, if there is a mechanical breakdown in the switching mechanism that prevents the switch from fully opening or closing, the indication 166 may provide a warning or alert to a switch operator of an error condition.

If switch operation is successful, the controller further proceeds to determine 168 whether the stored energy mechanism remained in a loaded position. The controller also determines if there were other adverse effects caused by the command 154 to move the motor. Once the movement is complete, the controller allows the switching mechanism to be released to allow the stored energy mechanism to complete the movement back to a mechanically neutral, unloaded position in a controlled manner. In an exemplary embodiment, the determination 168 of loading is accomplished by comparing an actual degree of rotation of the switch handle with an empirically determined degree of rotation needed to release the switch mechanism for ideal operation of the stored energy mechanism to move the switch mechanism to the opened or closed positions.

When spring elements are used in the stored energy mechanism, energy stored in the mechanism is directly proportional to amount of deflection of the spring elements, and the deflection of the spring elements corresponds directly to the rotation of the switching mechanism that charges the spring elements. The difference between the actual and predetermined rotations of the handle therefore reveals the loading of the stored energy mechanism. When the mechanism rotates far enough for the lock to release, the switch operates. It then must rotate back to its rest position. By comparing the actual and predetermined degree of rotation of the motor that drives the handle rotation when the switch is in its rest position to the predetermined degree of rotation, an overload or underload of the stored energy in the switch mechanism may be determined and corrected.

Thus, for example, if the controller compares the actual and predetermined amounts of rotation and the actual degree of rotation is different from the predetermined degree of rotation, loading of the stored energy mechanism is indicated. If the actual degree of rotation is greater than the predetermined degree of rotation by an amount x, the switch handle has been moved by the motor beyond the predetermined position by the amount x until the switching mechanism was released, and overloading of the stored energy is determined 170. If an overload is determined 170, the controller resets 174 the stored energy mechanism to remove the overload. Specifically, the controller resets the stored energy mechanism by energizing the motor to turn the switch handle in a second rotational direction, opposite to the first rotational direction, by an amount equal to x. As such, the additional loading in the stored energy caused by the amount x is removed and the stored energy mechanism is again returned to its neutral state and is ready for use.

In one embodiment, the controller is programmed to energize the motor to move the switch handle to the predetermined release position plus an amount x each time the switch mechanism is moved between the opened and closed positions. In such an embodiment, the amount x is not a variable but is a constant, and the controller resets 174 the stored energy mechanism by rotating the switch handle in an opposite direction by a constant amount equal to the value x. That is, the controller intentionally energizes the motor to load the stored energy by a specified amount, and then resets the mechanism accordingly.

In another embodiment, the controller is programmed to pulse the motor until the release position is released for the switch mechanism and the switch mechanism is driven to the opened or closed position by the stored energy mechanism. In this type of embodiment, the rotation of the motor to move the handle until the switch mechanism is released is not a constant but rather is a variable. Thus, it is possible that the rotation of the motor necessary to release the switch mechanism may actually be less than the predetermined degree of rotation. If the actual degree of rotation in the first direction of rotation is less than the predetermined degree of rotation by an amount y, underloading of the stored energy is determined 176. If an underload is determined 176, the controller may reset 178 the stored energy mechanism by commanding the motor to move the handle further in the first rotational direction by an amount equal to y to reset or restore the stored energy mechanism to its neutral state.

If the actual degree of rotation is equal to the predetermined degree of rotation, no loading of the stored energy mechanism is determined 180, and no resetting 182 of the stored energy mechanism is performed.

In still another embodiment, the loading determination 168 may be based upon actual and anticipated torque input for the motor. That is, an empirically determined torque input by the motor to release the switching mechanism under normal conditions could be determined, and an actual torque input applied by the motor could be sensed. By comparing the sensed torque input by the motor with the predetermined torque input, overloading, underloading or no loading of the stored energy may be determined 170, 176, 180, respectively. Additionally, if the actual input torque is known, the rotation of the handle needed to reset the stored energy mechanism to a neutral position can be calculated, and the stored energy mechanism can be reset 174, 178 accordingly. As before, the actual input torque of the motor may be a constant value or a variable value in different embodiments, and the stored energy mechanism may be rest by a constant amount or a variable amount, respectively, depending on the configuration of the system 126 to determine loading of the stored energy mechanism.

Once any resetting 174, 178 of the stored energy mechanism is accomplished, the controller sets 184 a dwell period or timer to let the switching mechanism and the stored energy mechanism stabilize before another switch operation is undertaken to move the switch mechanism. Until the dwell period expires 186, the switch is disabled 188 and the controller is unresponsive to further input commands to operate the switch. That is, the operation of the switch is temporarily suspended by the controller for a predetermined time. Once the dwell period 186 has expired the controller is again responsive to accept 152 input commands. In various embodiments, the dwell time may range, for example, to a duration of less than a second to durations of several minutes or longer, depending on user preference and configuration of the switch. Practically speaking, the dwell time duration is selected to ensure that switching has been completed successfully and that the equipment has stabilized prior to initiation of another switching operation.

Using the method 150, any necessary resetting of the stored energy mechanism may be accomplished automatically by the motor 127 and the controller 128 without accessing the interior of the switch casing 114, thereby allowing the switch 100 to be operated in less time and with less difficulty. The controller is fully responsive to varying amounts of torque needed to move the switch handle to its release position, and the controller compensates for varying contact pressures and resistance to movement that the switching mechanism may experience over time. By ensuring that any loading of the stored energy mechanism is removed, safe and reliable operation of the switch is also ensured. Additionally, by providing verification or confirmation of the switch operating state to an operator, an additional degree of safety is provided in that error conditions are flagged for human operators, and the operators may take appropriate precautions before approaching the switch in a fault condition.

Having now described the exemplary methodology, programming of the controller can be provided conventionally to implement the control system. Additional details of exemplary switches and sensors for use with the control system 126 and method 150 will now be described.

Figure 3:
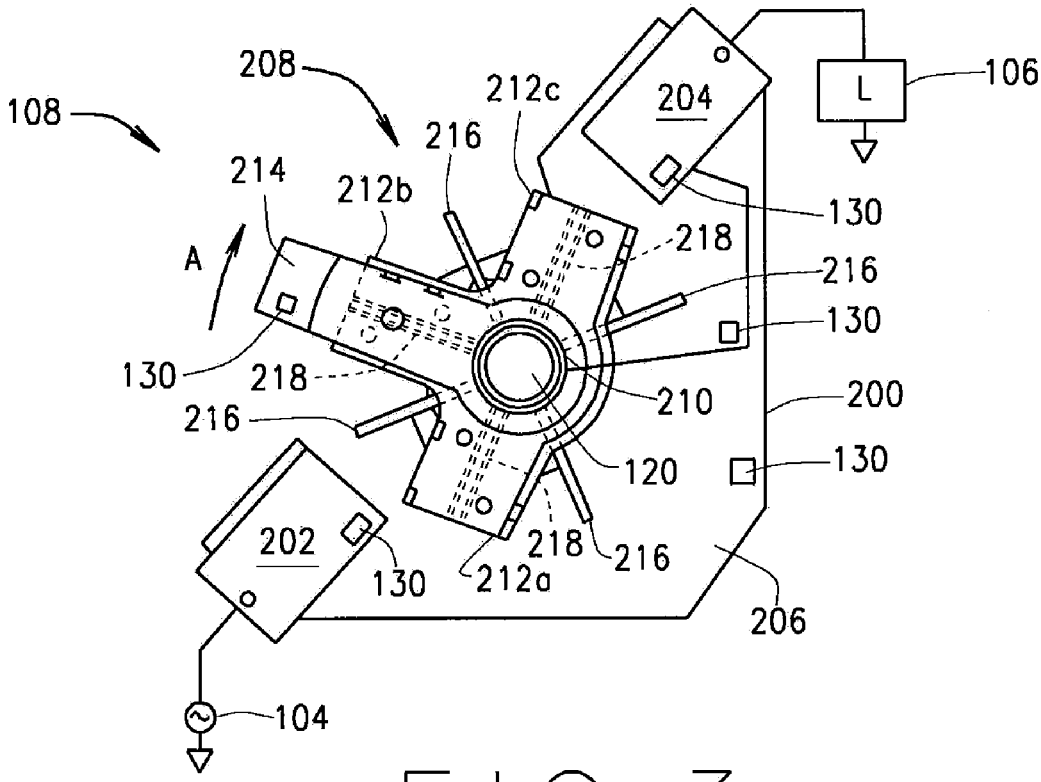
FIG. 3 is a rear view of a switching mechanism for the switch shown in FIG. 1.

FIG. 3 illustrates an exemplary rotating switching mechanism 108 that may be used in the system 126 and method 150 in an exemplary embodiment.

The rotating switching mechanism 108 includes a switch block 200 that supports elements of the rotating switching mechanism 108 in a desired spacing. The switch block 200 generally may be of any suitable shape, such as, for example, a triangular, square, or pentagonal shape. Corners of the switch block 200 may include, respectively, stationary contacts 202, 204. The first stationary contact 202 is connected to the high-voltage power source 104 while the second stationary contact 204 is connected to the load 106. In a further embodiment, a third corner 206 of the switch block 200 also includes a stationary contact.

The rotating loadbreak switching mechanism 108 includes the rotating center shaft 120, and the handle 122 is an extension of the shaft 120 and may be mechanically linked to the motor 127 shown in FIG. 1. A rotor 208 is coupled to the rotating center shaft 120 and rotates based on rotation of the rotating center shaft 120. A center hub 210 may connect the rotor 208 non-switchably to a fixed contact mounted to the switch block, in position 206. The rotor 208 includes retaining arms 212*a*, 212*b*, 212*c* that are positioned at 90° angles relative to one another in a T-shaped configuration and that radiate from the radial axis of the rotor 208. Each of retaining arms 212*a*, 212*b*, 212*c* is configured or adapted to retain a contact blade 214. In the example shown in FIG. 3, one of the retaining arms 212*b* is populated with a contact blade 214 while the other retaining arms 212*a*, 212*c* are left unpopulated. Consequently, as shown in FIG. 3, the rotor 208 provides a single-blade switching mechanism.

The rotor 208 may be rotated to bring the stationary contact 202 and the contact blade 214 into electrical contact, or to move the contact blade 214 apart from the stationary contact 204 to break that electrical contact. Optionally, the rotor 208 also includes one or more paddles 216 that lie on the same radial axis of the rotor 208 as the retaining arms 212*a*, 212*b*, 212*c*. The paddles 216 may be placed at angles, such as 45° in one embodiment, relative to the retaining arms 212*a*, 212*b*, 212*c*. Each paddle 216 is adapted to present a significant surface to a direction of rotation of the rotor 208 through the dielectric fluid 116. In addition, or in the alternative, the retaining arms 212*a*, 212*b*, 212*c* may be adapted with paddle-like features such as ridges 218 to circulate dielectric fluid 116.

The rotor 208 may be rotated, for example, in a clockwise direction represented by arrow A for a specified number of degrees to break contact with the high-voltage power source 104 at the stationary contact 202. This is accomplished by driving the rotor 108 with the springs that store energy in the mechanism as the shaft 120 is rotated. When enough rotation of the shaft 120 is realized, the switch rotor 208 is released and the springs move the shaft 120.

One or more sensors 130 may be attached to the shaft 120, the blade 214, the contacts 202, 204, or elsewhere on the switch block 200 and communicate signals to the controller 128 to monitor a position of the movable rotor 208 relative to the stationary switch block 200 and fixed components. In different embodiments, the sensors 130 are position sensors such as proximity sensors, Hall effect sensors, optical sensors, magnetic sensors, potentiometers, and equivalents thereof as those in the art may appreciate.

Figure 4:
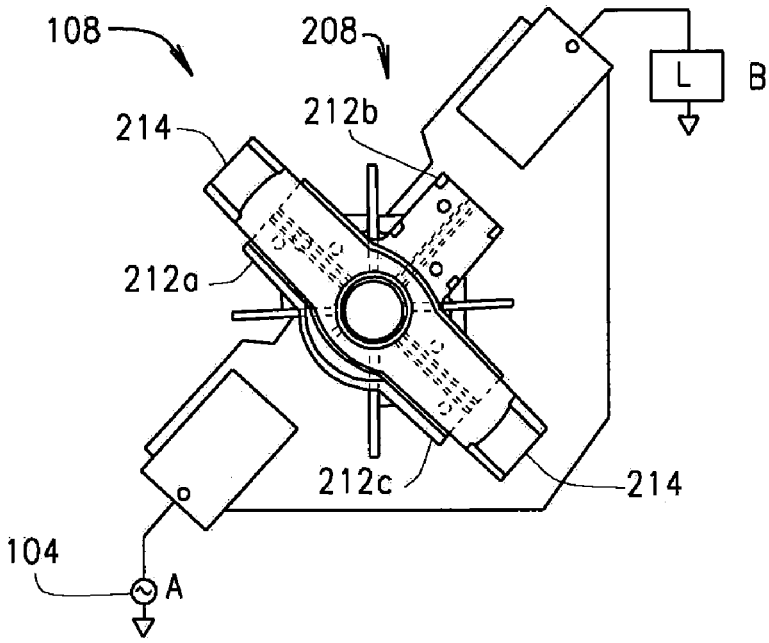
FIG. 4 is a rear view of an alternative configuration of the switching mechanism shown in FIG. 3.

FIG. 4 illustrates the switching mechanism 108 configured or adapted in a straight a straight-blade switching configuration wherein the rotor 208 includes contact blades 214 in the retaining arms 212*a* and 212*c*, while the retaining arm 212*b* is not populated with a contact blade. The straight-blade switching configuration may be used, for example, to switch a high-voltage power source A and a load B, such as the load 104.

Figure 5:
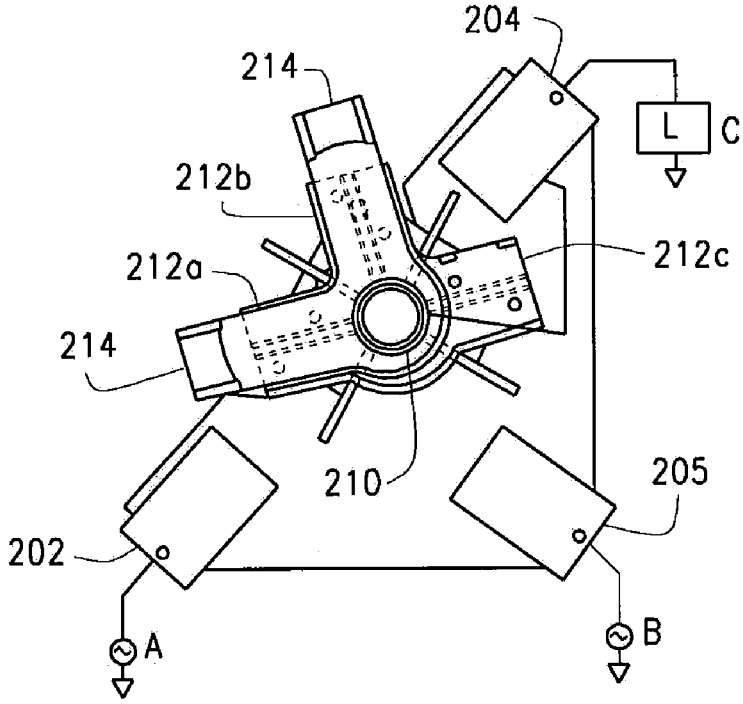
FIG. 5 is a rear view of another alternative configuration of the switching mechanism shown in FIG. 3.

FIG. 5 illustrates the switching mechanism 108 adapted in a V-blade switching mechanism wherein the retaining arms 212*a* and 212*b* with contact blades 214 to provide two rotating contacts of the same length at a 90° angle from each other. Three stationary contacts 202, 204 and 205 also are provided. Two of the stationary contacts 204, 205 are connected to a first high-voltage power source A and to a second high-voltage power source B, respectively. The third stationary contact 205 is connected to a load C, such as a transformer core-coil assembly and also is connected to the switch hub 210. The V-blade switching configuration may feed load C from source A and/or from source B, and may provide a completely open position in which the load C is connected to neither source A nor source B. Specifically the V-blade switching configuration may select an open circuit; a circuit between source A and load C; a circuit between source B and load C; or a circuit between sources A and B, and load C. Other configurations of the V-blade switch are possible. For example, in an alternative implementation, the V-blade switching mechanism may be adapted to switch two loads between one power source.

Figure 6:
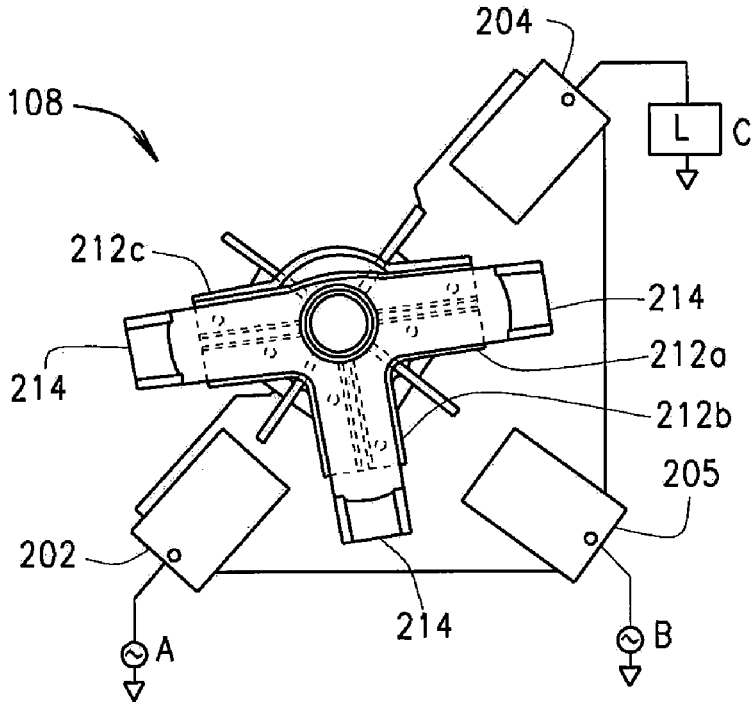
FIG. 6 is a rear view of another alternative configuration of the switching mechanism shown in FIG. 3.

FIG. 6 illustrates the switching mechanism 108 in a T-blade configuration wherein each of the retaining arms 212*a*, 212*b*, 212*c* are populated with a contact blade 214. Hence, the T-blade configuration provides three rotating contacts of the same length, each at a 90° angle from the other. Three stationary contacts 202, 204, 205 also are provided. Each stationary contact 202 and 204 is attached to a power source A and B, respectively, and the stationary contact 205 is connected to a load C. The T-blade switching configuration may connect the load C to source A and/or to source B. Alternatively, the T-blade switching mechanism may connect together sources A and B while leaving the load C connected to neither source. In sum, the T-blade switching mechanism may form circuits between sources A and B; source A and load C; source B and load C; or sources A and B and load C. Other configurations of the T-blade switch are possible. For example, in an alternative implementation, the T-blade switching mechanism may be adapted to switch two loads between one power source.

Figure 7:
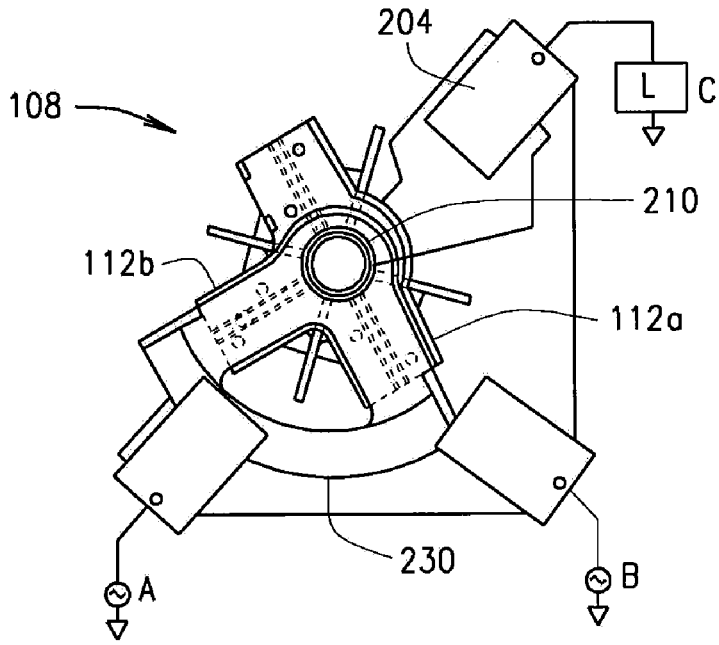
FIG. 7 is a rear view of another alternative configuration of the switching mechanism shown in FIG. 3.
Figure 8:
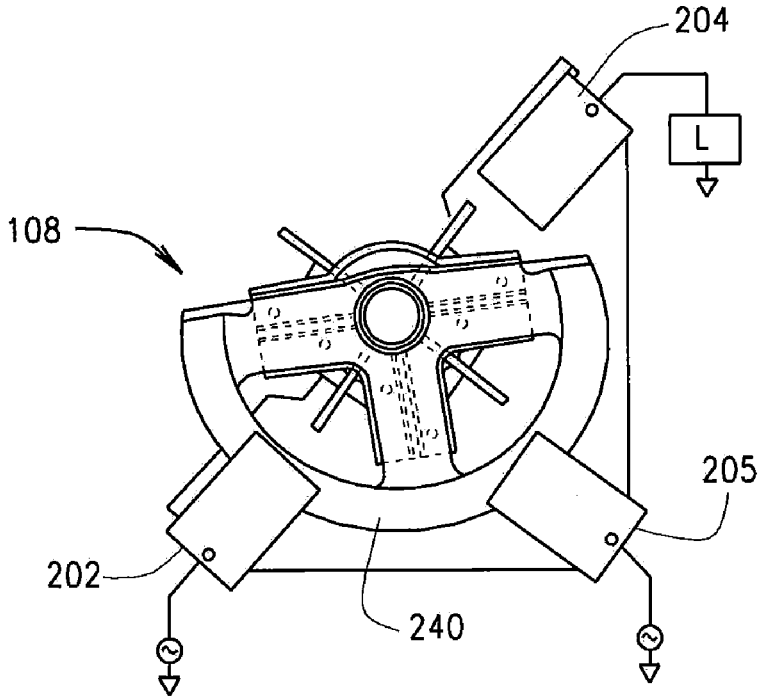
FIG. 8 is a rear view of another alternative configuration of the switching mechanism shown in FIG. 3.

FIGS. 7 and 8 illustrate V-blade and T-blade configurations of make-before-break (MBB) switching configurations of the switching mechanism 108. In a make-before-break switching mechanism, a rotating electrical contact is sized such that, when a load is switched between a first and a second power source, coupling of the first power source to the load is not broken until the second power source is coupled to the load. As such, the make-before-break switching mechanism ensures that a first connection is not broken until after a second connection has been made. The power sources may be synchronized to not create a power fault during the time that both the first connection and the second connection are maintained while switching. Moreover, with respect to either the V-blade or the T-blade switching mechanisms other switching configurations may be used. For example, the switching mechanisms may be adapted to switch two loads between a single power source.

Referring to FIG. 7, a make-before-break V-blade configuration includes an arc-shaped rotating contact 230 that populates the retaining arms 112*a* and 112*b*. The MBB V-blade switching mechanism may be used, for example, in a high-voltage application in which it is desired to switch a load C from an initial power source, such as source A to an alternate power source, such as source B, without interruption. To switch as described, the load C may be connected to a stationary contact that also is connected to the hub 210.

FIG. 8 illustrates a make-before-break T-blade switching configuration including an arc-shaped rotating contact 240 similar generally to the rotating contact 230 shown in FIG. 7, but describing a greater arc. The switching capability of the MBB T-blade switching configuration is similar to that of a standard T-blade switching configuration but with added make-before-break functionality. The rotating contact 240 describes a semi-circular arc and is sized such that it can electrically couple three stationary contacts 202, 204, 205 before breaking a previous connection. For example, the MBB T-blade switching configuration may be actuated to complete a connection between sources A and B and load C. Alternatively, the MBB T-blade switching configuration may complete a circuit between any two of source A, source B, and load C.

Figure 9:
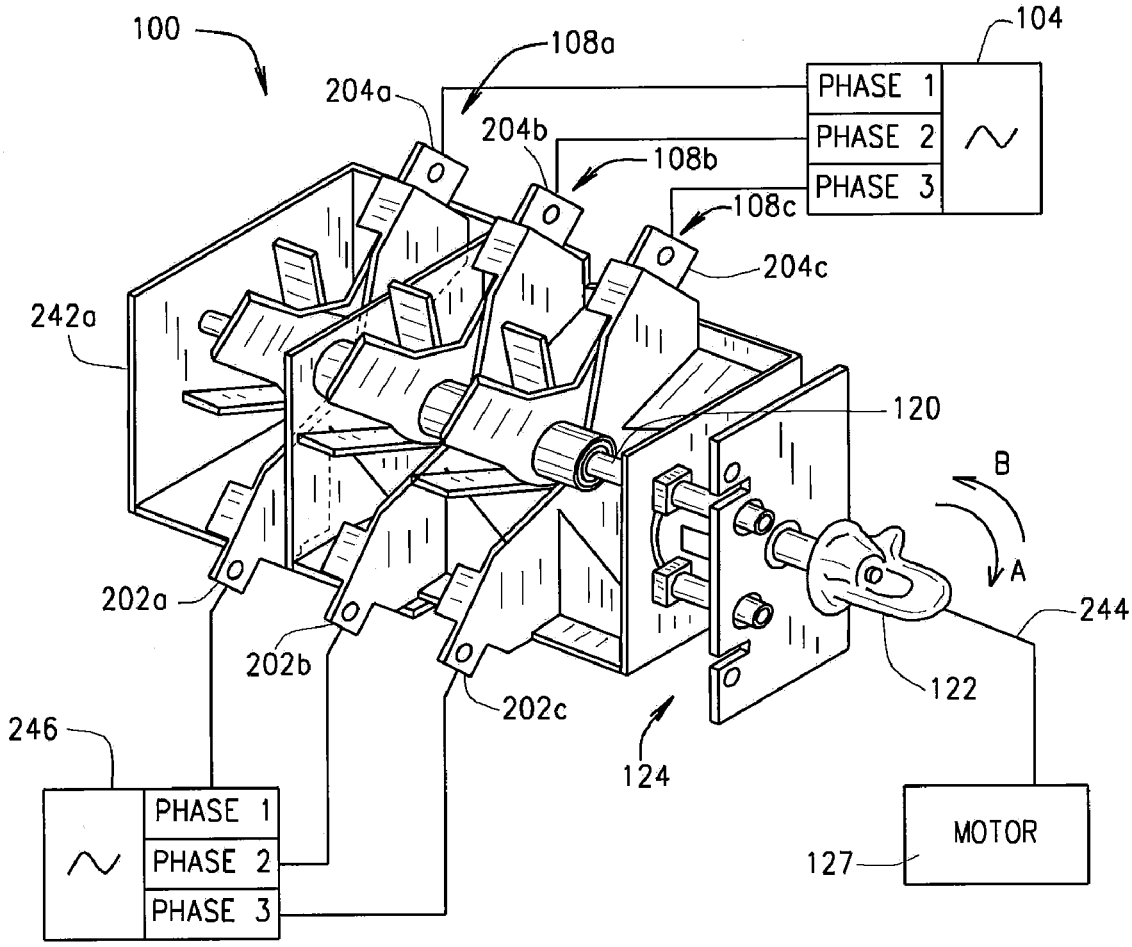
FIG. 9 illustrates a three-phase power switch that may be used in the system shown in FIG. 1.

FIG. 9 illustrates the switch 100 including for example, three rotating switching mechanisms 108*a*, 108*b*, 108*c* that may be any of the configurations described previously in relation to FIGS. 3-8. Each of rotating switching mechanisms 108*a*, 108*b*, 108*c* is adapted to switch a single phase of one or more power sources, and/or one or more loads.

For example, a first high-voltage power source 104 might connect its first phase to stationary contact 204*a*, its second phase to stationary contact 204*b*, and its third phase to stationary contact 204*c*. A second high-voltage power source 246 might connect its first, second, and third phases to stationary contacts 202*a*, 202*b* and 202*c*, respectively. Thus, a first switching mechanism 108*a* may select alternatively between the first phase of the first and second power sources with the stationary contacts 204*a* and 202*a*, a second switch component 108*b* may alternatively select between the second phase of the first and second power sources with the stationary contacts 204*a* and 202*b*), and a third switch component 108*c* may alternatively select between the last phase of the first or second power sources with stationary contacts 204*c* and 202*c*.

The three-phase power switch 100 may be adapted to switch simultaneously each of the rotating switches 108*a*, 108*b*, 108*c*. More specifically, the switching mechanisms 108*a*, 108*b*, 108*c* are carried on the longitudinally extending shaft 120, and the handle 122 is extended from the shaft 120 and extends axially therefrom. The handle 122 may be rotated, for example, in a first direction of rotation, indicated by the arrow A to charge the stored energy mechanism 124 that is also coupled to the shaft 120. The shaft 120 may connect each of rotating switching mechanisms 108*a*, 108*b*, 108*c*. For example, the shaft 120 may extend through a rotational axis of each rotating switching mechanisms 108*a*, 108*b*, 108*c*. When released, the stored energy mechanism 124 may cause the shaft 120 to rotate the rotating switching mechanisms 108*a*, 108*b*, 108*c* simultaneously, at a speed independent of the speed of the operator. Alternatively, each of rotating switching mechanisms 108*a*, 108*b*, 108*c* may include a separate actuator to actuate each of rotating switching mechanisms 108*a*, 108*b*, 108*c* based on rotation of shaft 120. In either event, the three-phase power switch 100 may be used to switch simultaneously from the three phases of the first power source 104 to the three phases of the second power source 246. Alternatively, the three-phase power switch 100 may be adapted to switch two loads between a single three-phase power source.

Once the switching mechanisms 108*a*, 108*b*, 108*c* are completely rotated in the first direction of arrow A, the handle 122 may be rotated in a second direction, indicated by arrow B, opposite to the direction of arrow A to reset the stored energy mechanism as described above. The motor 127 is connected to the handle 122 with a mechanical linkage 244 so that as the motor output shaft rotates a given amount in the direction of arrows A and B, so does the handle 122. The linkage 244 may be manually disconnected from the handle 122 if needed or as desired, and the handle 122 may be manually rotated to operate the switch and/or reset the stored energy mechanism 124. In one embodiment the handle 122 may be rotated about 360° about its axis between first and second operating conditions of the switch 100.

Baffles 242*a* and 242*b* may be provided to form an electrical barrier to suppress arcing between the separate phases, or between a phase and ground, that otherwise might cause damage to the three-phase power switch 100. By preventing an initial phase-to-phase or phase-to-ground arc from occurring, the baffles 242*a* and 242*b* may increase safety and reliability of the three-phase power switch 100.

Figure 10:
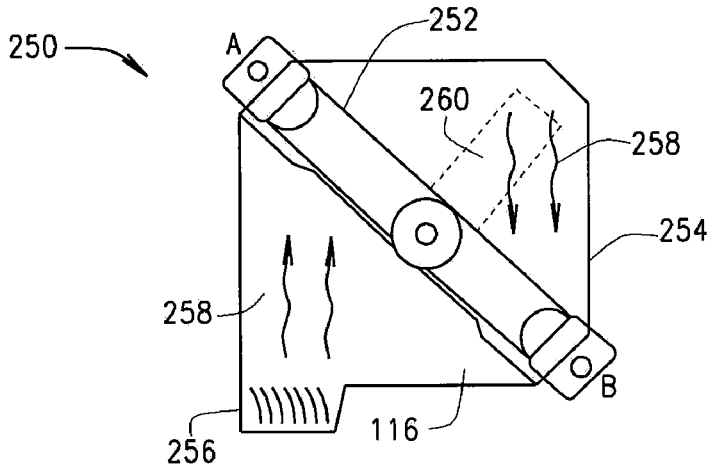
FIG. 10 illustrates an additional rotating switching mechanism for the system shown in FIG. 1.

FIG. 10 illustrates an additional rotating switching mechanism 250 that may be used in lieu of the mechanisms 108 described above to implement the high-voltage loadbreak switch 100. The rotating switching mechanism 250 includes a straight blade contact rotor 252. The straight blade contact rotor 252 is adapted to connect or disconnect a first stationary contact A and a second stationary contact B in a manner similar to that described previously. A casing 254 retains components of the rotating switching mechanism 250 submerged in the dielectric fluid 116. Optionally, the rotating switching mechanism 250 circulates the dielectric fluid 116 using a convection mechanism. More specifically, the rotating switching mechanism 250 may include a heating element 256 adapted to induce a convection current 258 in the dielectric fluid 116 by heating the dielectric fluid 116 at a lower portion of the casing 254. The heated dielectric fluid 116 rises from the lower portion of the casing 254 and causes cooler dielectric fluid 116 of an upper portion of the casing 254 to settle in the convection current 258. In this manner, the convection current 258 causes the dielectric fluid 116 to circulate and disperse a buildup of impurities. The rotating switching mechanism 250 employ convection circulation alone or in combination with other methods or systems of arc suppression, such as, for example, a paddle and/or a baffle.

The straight blade rotor 252 may be provided with an additional leg 260 and contact to reconfigure the switching mechanism to a V-blade configuration, a T-blade configuration, or a mate before break configuration similar to those described above.

One embodiment of a high voltage loadbreak switch system is described herein that includes at least one stationary contact; a rotatable switching mechanism comprising a handle and at least one contact blade, the switching mechanism selectively positionable to position the contact blade relative to the stationary contact; a stored energy mechanism assisting movement of the rotatable switching mechanism relative to the switching contact; a motor coupled to the handle; and a controller communicating with the motor. The controller is adapted to energize the motor to rotate the handle; and reset the stored energy mechanism to remove any loading of the stored actuating mechanism when rotating the handle to the release position.

Optionally, the controller is further adapted to determine at least one of an overload condition of the stored energy mechanism, an underload condition of the stored energy mechanism, or a no load condition of the stored energy mechanism. At least one sensor may be provided, the controller may be adapted to determine whether switch operation was successful based on signals from the sensor. The controller may be adapted to suspend operation of the switch for a predetermined dwell time after the switching mechanism is moved. A control interface with at least one input selector and at least one indicator may also be provided.

In another embodiment, a high voltage loadbreak switch system is provided. The system includes at least one stationary contact, and a rotatable switching mechanism comprising a rotating shaft and a handle extending axially therefrom, the switching mechanism further comprising at least one rotor comprising at least one contact blade, the contact blade being selectively positionable relative to the stationary contact via rotation of the shaft. A stored energy mechanism is connected to the shaft and assisting movement of the rotatable switching mechanism relative to the switching contact. A motor is mechanically linked to the handle, and at least one sensor monitors a position of the switching mechanism relative to the stationary contact. A controller communicates with the motor and is adapted to energize the motor to rotate the handle; and determine, based upon a signal from the at least one sensor, whether the switching mechanism has completely rotated from a first operating position to a second operating position.

Another embodiment of a high voltage loadbreak switch system is also described herein. The system includes a three phase, high voltage loadbreak switch, the switch comprises: a casing; stationary contacts located within the casing, each of the contacts corresponding to a respective phase of a three phase electrical power source; a rotatable switching mechanism comprising a rotating shaft and a handle extending axially therefrom, the switching mechanism further comprising a plurality of rotors connected to the shaft, each rotor corresponding to one phase of the electrical power source and comprising at least one movable contact blade, the contact blade of each rotor being selectively positionable relative to the respective stationary contact via rotation of the shaft; and a stored energy mechanism connected to the shaft and assisting movement of the rotatable switching mechanism relative to the switching contact. A motor is mechanically linked to the handle, and at least one sensor monitors a position of the switching mechanism relative to the stationary contact. A controller communicates with the motor and is adapted to: energize the motor to rotate the handle; reset the stored energy mechanism to remove any loading of the stored actuating mechanism when rotating the handle; and determine, based upon a signal from the at least one sensor, whether the switching mechanism has completely rotated from a first operating position to a second operating position.

A method of actuating a high voltage loadbreak switch is also described herein. The switch includes at least one stationary contact, a rotatable switching mechanism comprising a handle and at least one contact blade. The switching mechanism is selectively positionable to position the contact blade relative to the stationary contact, and a stored energy mechanism assists movement of the rotatable switching mechanism relative to the switching contact. The method includes coupling a motor to the handle; and controlling the motor to: energize the motor to rotate the handle; and reset the stored energy mechanism to remove any loading of the stored actuating mechanism when rotating the handle.

Optionally, the method further includes sensing a movement of the switching mechanism; and indicating to an operator whether the movement of the switching mechanism is successful.

Another embodiment of a high voltage loadbreak switch system is also described. The system includes a high voltage loadbreak switch, the switch comprising: a casing; at least one stationary contact located within the casing; and a rotatable switching mechanism comprising a rotating shaft and a handle extending axially therefrom, the switching mechanism further comprising at least one rotor connected to the shaft, the rotor being selectively positionable relative to the stationary contact via rotation of the shaft. Means for storing energy as the handle is rotated are provided, and the means for storing energy assists movement of the rotatable switching mechanism relative to the switching contact. Means for rotating the handle are provided, and means for controlling the means for rotating are also provided. The means for controlling the means for rotating removes any loading of the means for storing energy after switching operation is completed.

While the invention has been described in terms of various specific embodiments, those skilled in the art will recognize that the invention can be practiced with modification within the spirit and scope of the claims.

What is claimed is:

1. A loadbreak switch, comprising:

at least one stationary contact;

a rotatable switching mechanism comprising a handle and at least one contact blade, the switching mechanism selectively positionable to position the contact blade relative to the at least one stationary contact;

a stored energy mechanism configured to assist a movement of the rotatable switching mechanism relative to the at least one stationary contact;

a motor coupled to the handle; and a controller coupled to the motor and configured to:

energize the motor to rotate the handle, the rotation of the handle causing the rotatable switching mechanism to move relative to the at least one stationary contact, and adjust a load of the stored energy mechanism to correct one of an overload condition of the stored energy mechanism and an underload condition of the stored energy mechanism, the one of the overload condition and the underload condition being caused by the rotation of the handle.

2. The loadbreak switch of claim 1, wherein the controller is further configured to determine at least one of the overload condition of the stored energy mechanism, the underload condition of the stored energy mechanism, and a no load condition of the stored energy mechanism.

3. The loadbreak switch of claim 1, further comprising at least one sensor, wherein the controller is further configured to determine whether a switch operation of the loadbreak switch was successful based on signals from the sensor.

4. The loadbreak switch of claim 1, wherein the controller is further configured to suspend operation of the loadbreak switch for a predetermined dwell time after the rotatable switching mechanism is moved.

5. The loadbreak switch of claim 1, wherein the controller is further configured to energize the motor to rotate the handle in a first direction rotation to a release position, and to rotate the handle in a second direction to adjust the load of the stored energy mechanism, the second direction opposite to the first direction.

6. The loadbreak switch of claim 1, wherein the controller is further configured to adjust the load of the stored energy mechanism by rotating the handle in a predetermined direction for a predetermined constant amount.

7. The loadbreak switch of claim 1, wherein the controller is further configured to:

determine an amount of rotation of the motor in a first direction of rotation;

compare the determined amount of rotation to a predetermined amount of rotation;

when the determined amount of rotation is greater than the predetermined amount of rotation, actuate the motor in a second direction opposite to the first direction to adjust the load of the stored energy mechanism; and when the determined amount of rotation is less than the predetermined amount of rotation, actuate the motor in the first direction to adjust the load of the stored energy mechanism.

8. The loadbreak switch of claim 1, wherein the switching mechanism is configurable in multiple configurations, the configurations selected from the group consisting of a single blade configuration, a straight-blade switching configuration, a V-blade configuration, a T-blade configuration, and a make before break switching configuration.

9. The loadbreak switch of claim 1, wherein the rotatable switching mechanism is immersed in a dielectric fluid.

10. The loadbreak switch of claim 1, wherein the controller is connected to a remote operation control system configured to remotely monitor and control the loadbreak switch.

11. The loadbreak switch of claim 1, further comprising a control interface comprising at least one input selector and at least one indicator, the control interface being configured to:

accept, via the at least one input selector, operator input for controlling the loadbreak switch, and display information regarding the loadbreak switch via the at least one indicator.

12. The loadbreak switch of claim 1, wherein the rotatable switching mechanism is immersed in a dielectric fluid, and wherein the loadbreak switch further comprises a fluid circulation mechanism.

13. A loadbreak switch, comprising:

at least one stationary contact;

a rotatable switching mechanism comprising a rotatable shaft, a handle extending axially from the rotatable shaft, and at least one rotor comprising at least one contact blade, the contact blade being selectively positionable relative to the at least one stationary contact via rotation of the rotatable shaft;

a stored energy mechanism coupled to the shaft and configured to assist movement of the rotatable switching mechanism relative to the at least one stationary contact;

a motor mechanically linked to the handle;

at least one sensor configured to monitor a position of the rotatable switching mechanism relative to the at least one stationary contact; and a controller coupled to the motor and configured to:

energize the motor to rotate the handle;

determine, based upon a signal from the at least one sensor, whether the rotatable switching mechanism has rotated from a first operating position to a second operating position, determine at least one of an overload condition of the stored energy mechanism, an underload condition of the stored energy mechanism, and a no load condition of the stored energy mechanism, and adjust a load of the stored energy mechanism in response to determining one of the overload condition and the underload condition.

14. The loadbreak switch of claim 13, further comprising a control interface, and wherein the controller is further configured to indicate, via the interface, whether the rotatable switching mechanism has rotated from the first operating position to the second operating position.

15. The loadbreak switch of claim 13, wherein the sensor is selected from the group consisting of a proximity sensor, a ball effect sensor, an optical sensor, a magnetic sensor, and a potentiometer.

16. A loadbreak switch, comprising:

at least one stationary contact;

a rotatable switching mechanism comprising a rotatable shaft, a handle extending axially from the rotatable shaft, and at least one rotor comprising at least one contact blade, the contact blade being selectively positionable relative to the at least one stationary contact via rotation of the rotatable shaft;

a stored energy mechanism coupled to the shaft and configured to assist movement of the rotatable switching mechanism relative to the at least one stationary contact;

a motor mechanically linked to the handle;

at least one sensor configured to monitor a position of the rotatable switching mechanism relative to the at least one stationary contact;

a controller coupled to the motor and configured to:

energize the motor to rotate the handle, determine, based upon a signal from the at least one sensor, whether the rotatable switching mechanism has rotated from a first operating position to a second operating position, determine at least one of an overload condition of the stored energy mechanism, an underload condition of the stored energy mechanism, and a no load condition of the stored energy mechanism, and adjust a load of the stored energy mechanism in response to determining one of the overload condition and the underload condition; and a control interface, wherein the controller is further configured to indicate, via the control interface, whether the rotatable switching mechanism has rotated from the first operating position to the second operating position.

17. The loadbreak switch of claim 16, wherein the controller is configured to suspend operation of the loadbreak switch for a predetermined dwell time after the rotatable switching mechanism is moved.

18. The loadbreak switch of claim 16, wherein the rotatable switching mechanism is configurable in multiple configurations, the configurations selected from the group consisting of a single blade configuration, a straight-blade switching configuration, a V-blade configuration, a T-blade configuration, and a make before break switching configuration.

19. The loadbreak switch of claim 16, wherein the rotatable switching mechanism is immersed in a dielectric fluid.

20. The loadbreak switch of claim 16, wherein the controller is connected to a remote operation control system configured to remotely monitor and control the loadbreak switch.

21. A loadbreak switch, comprising:

a casing;

a plurality of stationary contacts located within the casing, each of the stationary contacts corresponding to a respective phase of a three phase electrical power source;

a rotatable switching mechanism comprising a rotatable shaft, a handle extending axially from the rotatable shaft, and a plurality of rotors coupled to the rotatable shaft, each of the rotors corresponding to a respective one of the stationary contacts and comprising at least one movable contact blade being selectively positionable relative to the respective one of the stationary contacts via rotation of the rotatable shaft;

a stored energy mechanism coupled to the rotatable shaft and configured to assist movement of the rotatable switching mechanism relative to the stationary contacts;

a motor mechanically linked to the handle of the rotatable switching mechanism;

at least one sensor configured to monitor a position of the rotatable switching mechanism relative to the stationary contacts; and a controller coupled to the motor and configured to:

energize the motor to rotate the handle, determine, based upon a signal from the at least one sensor, whether the rotatable switching mechanism has rotated from a first operating position to a second operating position, and determine at least one of an overload condition of the stored energy mechanism, an underload condition of the stored energy mechanism, and a no load condition of the stored energy mechanism.

22. The loadbreak switch of claim 21, further comprising a control interface, wherein the controller is further configured to indicate, via the interface, wheter the rotatable switching mechanism has rotated from the first operating position to the second operating position.

23. The loadbreak switch of claim 21, wherein the controller is further configured to adjust a load of the stored energy mechanism in response to determining one of the overload condition and the underload condition.

24. The loadbreak switch of claim 21, wherein the controller is further configured to suspend operation of the switch for a predetermined dwell time after the rotatable switching mechanism is moved.

25. The loadbreak switch of claim 21, wherein the rotatable switching mechanism is configurable in multiple configurations, the configurations selected from the group consisting of a single blade configuration, a straight-blade switching configuration, a V-blade configuration, a T-blade configuration, and a make before break switching configuration.

26. The loadbreak switch of claim 21, wherein the rotatable switching mechanism is immersed in a dielectric fluid.

27. A method of actuating a loadbreak switch comprising at least one stationary contact, a rotatable switching mechanism comprising a handle and at least one contact blade and being selectively positionable to position the contact blade relative to the at least one stationary contact, and a stored energy mechanism configured to assist movement of the rotatable switching mechanism relative to the at least one stationary contact, the method comprising the steps of:

coupling a motor to the handle; and controlling the motor to:

energize the motor to rotate the handle, and adjust a load of the stored energy mechanism to correct one of an overload condition of the stored energy mechanism and an underload condition of the stored energy mechanism, the one of the overload condition and the underload condition being caused by the rotation of the handle.

28. The method of claim 27, further comprising the steps of:

sensing a movement of the rotatable switching mechanism; and indicating to an operator whether the movement of the rotatable switching mechanism was successful.

29. The method of claim 27, wherein the step of controlling the motor to adjust the load of the stored energy mechanism comprises the step of rotating the handle in a predetermined direction for a predetermined constant amount.

30. The method of claim 27, wherein the step of controlling the motor to adjust the load of the stored energy mechanism comprises the steps of:

energizing the motor to rotate the handle in a first direction to a release position; and rotating the handle in a second direction to adjust the load of the stored energy mechanism, the second direction opposite to the first direction.

31. The method of claim 27, further comprising the step of determining at least one of the overload condition of the stored energy mechanism, the underload condition of the stored energy mechanism, and a no load condition of the stored energy mechanism.

32. The method of claim 27, further comprising the step of controlling the motor to suspend operation of the loadbreak switch for a predetermined dwell period.

33. A loadbreak switch, comprising:

a casing;

at least one stationary contact located within the casing, a rotatable switching mechanism comprising a rotatable shaft, a handle extending axially from the rotating shaft, and at least one rotor coupled to the rotatable shaft, the at least one rotor being selectively positionable relative to the at least one stationary contact via rotation of the rotatable shaft;

means for storing energy as the handle is rotated, the means for storing energy assisting movement of the rotatable switching mechanism relative to the at least one stationary contact;

means for rotating the handle;

means for controlling the means for rotating to adjust a load of the means for storing energy to correct one of an overload condition of the means for storing energy and an underload condition of the means for storing energy, the one of the overload condition and the underload condition being caused by the rotation of the handle.

34. The loadbreak switch of claim 33, further comprising means for sensing a position of the switching mechanism relative to the stationary contact, and means for indicating the position to an operator.

35. The loadbreak switch of claim 33, wherein the rotatable switching mechanism is immersed in dielectric fluid.

36. The loadbreak switch of claim 35, further comprising means for circulating the dielectric fluid within the casing.

37. The loadbreak switch of claim 13, wherein the controller is configured to determine the at least one of the overload condition, the underload condition, and the no load condition, and to adjust the load by:

determining an amount of rotation of the motor in a first direction of rotation;

comparing the determined amount of rotation to a predetermined amount of rotation;

when the determined amount of rotation is greater than the predetermined amount of rotation, actuating the motor in a second direction opposite to the fist direction to adjust a load of the stored energy mechanism; and when the determined amount of rotation is less than the predetermined amount of rotation, actuating the motor in the first direction to adjust a load of the stored energy mechanism.

38. The loadbreak switch of claim 13, further comprising a control interface configured to accept, via at least one input selector, operator input for controlling the loadbreak switch.

39. The loadbreak switch of claim 16, wherein the control interface is further configured to accept, via at least one input selector, operator input for controlling the loadbreak switch.

40. The loadbreak switch of claim 21, further comprising a control interface configured to accept, via at least one input selector, operator input for controlling the loadbreak switch.

41. The loadbreak switch of claim 13, wherein the controller is configured to suspend operation of the loadbreak switch for a predetermined dwell time after the rotatable switching mechanism is moved.

42. The loadbreak switch of claim 13, wherein the rotatable switching mechanism is configurable in multiple configurations, the configurations selected from the group consisting of a single blade configuration, a straight-blade switching configuration, a V-blade configuration, a T-blade configuration, and a make before break switching configuration.

43. The loadbreak switch of claim 13, wherein the rotatable switching mechanism is immersed in a dielectric fluid.

44. The loadbreak switch of claim 13, wherein the controller is connected to a remote operation control system configured to remotely monitor and control the loadbreak switch.

* * * * *